United States Patent [19]

Betts

[11] 4,014,262

[45] Mar. 29, 1977

[54] BLAST SIMULATOR

[75] Inventor: Robert E. Betts, Huntsville, Ala.

[73] Assignee: The United States of America as represented by the Secretary of the Army, Washington, D.C.

[22] Filed: Feb. 4, 1975

[21] Appl. No.: 546,980

[52] U.S. Cl. ..... 102/28 R; 102/37.2

[51] Int. Cl.[2] ..... F42B 4/18

[58] Field of Search ..... 102/28, 28 R, 29, 37.2, 102/39, 46, 70.2; 116/105

[56] References Cited

UNITED STATES PATENTS

| | | | |
|---|---|---|---|
| 1,591,367 | 7/1926 | Cryer | 116/105 |
| 2,309,978 | 2/1943 | Pratt | 102/39 |
| 2,368,018 | 1/1945 | Groth et al. | 102/37.2 |
| 2,801,585 | 8/1957 | Smith | 102/28 M |
| 3,762,331 | 10/1973 | Vlahos | 102/70.2 R |

*Primary Examiner*—Verlin R. Pendegrass
*Attorney, Agent, or Firm*—Nathan Edelberg; Robert P. Gibson; Charles R. Carter

[57] ABSTRACT

A blast simulator for use as a noise environment tester in a simulated missile launcher. The blast simulator includes a cylinder capped at both ends by a paper disc and encloses a pyrotechnic charge. An electric squib is inserted through either the cylinder walls or the end discs and when actuated ignites the pyrotechnic charge.

1 Claim, 2 Drawing Figures

BLAST SIMULATOR

DEDICATORY CLAUSE

The invention described herein may be manufactured, used, and licensed by or for the Government for governmental purposes without the payment to me of any royalties thereon.

BACKGROUND OF THE INVENTION

This invention relates to the field of blast simulators. Present blast simulators act upon pressurization of a chamber and a diaphram is ruptured producing the desired sound effect. Such design has produced defects such as variability of performance over temperature ranges and a variability of performance due to variance in packaging.

SUMMARY OF THE INVENTION

The present invention has overcome these problems by using an electric squib to ignite pyrotechnic charge and vastly reducing the cost while achieving the same sound effect.

This invention may be better understood from the following detailed description taken in conjunction with the accompanying drawing.

DESCRIPTION OF THE PREFERRED EMBODIMENT

Figure 1:
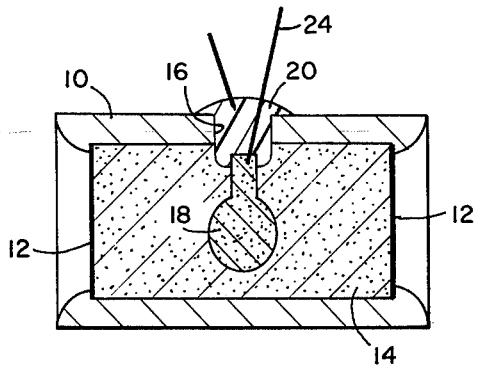
FIG. 1 is a sectional view of the blast simulator.

Reference numeral 10 identifies a paper cylinder tube capped at both ends by a paper wad or disc 12. The cylinder and disc enclose a pyrotechnic charge 14 and is provided with an opening 16 through which an electric squib 18 extends and is placed in the pyrotechnic charge. A sealant 20 is placed over the opening 16 to seal the charge against moisture and to mechanically retain the squib to the tube.

Figure 2:
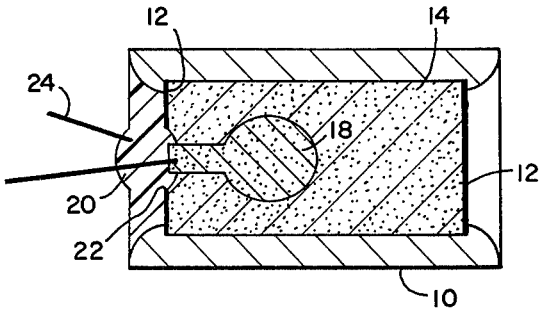
FIG. 2 is a sectional view of a modified blast simulator.

As shown in FIG. 2 the squib 18 is placed through an opening 22 in the end disc 12.

In operation an electric current is passed through the wires 24 to the squib which ignites the squib charge. The squib charge then ignites the pyrotechnic charge 14. The degree of confinement, type and amount of pyrotechnic, and reaction rate of the pyrotechnic determines the sound level generated.

I claim:

1. A blast simulator for a noise environment tester in a simulated missile launcher, said blast simulator comprising: a cylindrical tube provided with openings at the ends thereof, said tube provided with an opening between said ends; a pyrotechnic charge disposed within said tube and between said ends; a disc disposed in each end to enclose said charge, an electric squib disposed in said opening between the cylinder ends; means for protecting said pyrotechnic charge against moisture, said protecting means including a sealant placed over said opening to seal said pyrotechnic charge and wires connected to said squib to ignite said squib and said pyrotechnic charge.

* * * * *